US007119746B2

(12) United States Patent
Luk et al.

(10) Patent No.: US 7,119,746 B2
(45) Date of Patent: Oct. 10, 2006

(54) WIDEBAND PATCH ANTENNA WITH MEANDERING STRIP FEED

(75) Inventors: Kwai-Man Luk, Kowloon (HK); Hau Wah Lai, Kowloon (HK)

(73) Assignee: City University of Hong Kong, Kowloon (HK)

( * ) Notice: Subject to any disclaimer, the term of this patent is extended or adjusted under 35 U.S.C. 154(b) by 0 days.

(21) Appl. No.: 10/969,340

(22) Filed: Oct. 21, 2004

(65) Prior Publication Data

US 2006/0097921 A1 May 11, 2006

(51) Int. Cl.
*H01Q 1/24* (2006.01)

(52) U.S. Cl. ..... 343/702; 343/700 MS; 343/846

(58) Field of Classification Search ..... 343/700 MS, 343/702, 846
See application file for complete search history.

(56) References Cited

U.S. PATENT DOCUMENTS

| | | | | |
|---|---|---|---|---|
| 4,724,443 | A * | 2/1988 | Nysen | 343/700 MS |
| 6,342,856 | B1 * | 1/2002 | Nakano et al. | 343/700 MS |
| 6,593,887 | B1 * | 7/2003 | Luk et al. | 343/700 MS |
| 6,680,705 | B1 * | 1/2004 | Tan et al. | 343/702 |
| 2004/0145524 | A1 * | 7/2004 | Bae | 343/700 MS |
| 2005/0116867 | A1 * | 6/2005 | Park et al. | 343/725 |

* cited by examiner

*Primary Examiner*—Hoang V. Nguyen
(74) *Attorney, Agent, or Firm*—Barnes & Thornburg LLP

(57) ABSTRACT

There is described a patch antenna with a meandering strip feed. The antenna comprises a patch spaced from a ground plane, with the patch being substantially parallel with said ground plane, and a feed probe located between the patch and the ground plane. The feed probe comprises at least two portions parallel to the patch but spaced by different distances from the patch.

17 Claims, 6 Drawing Sheets

(d)

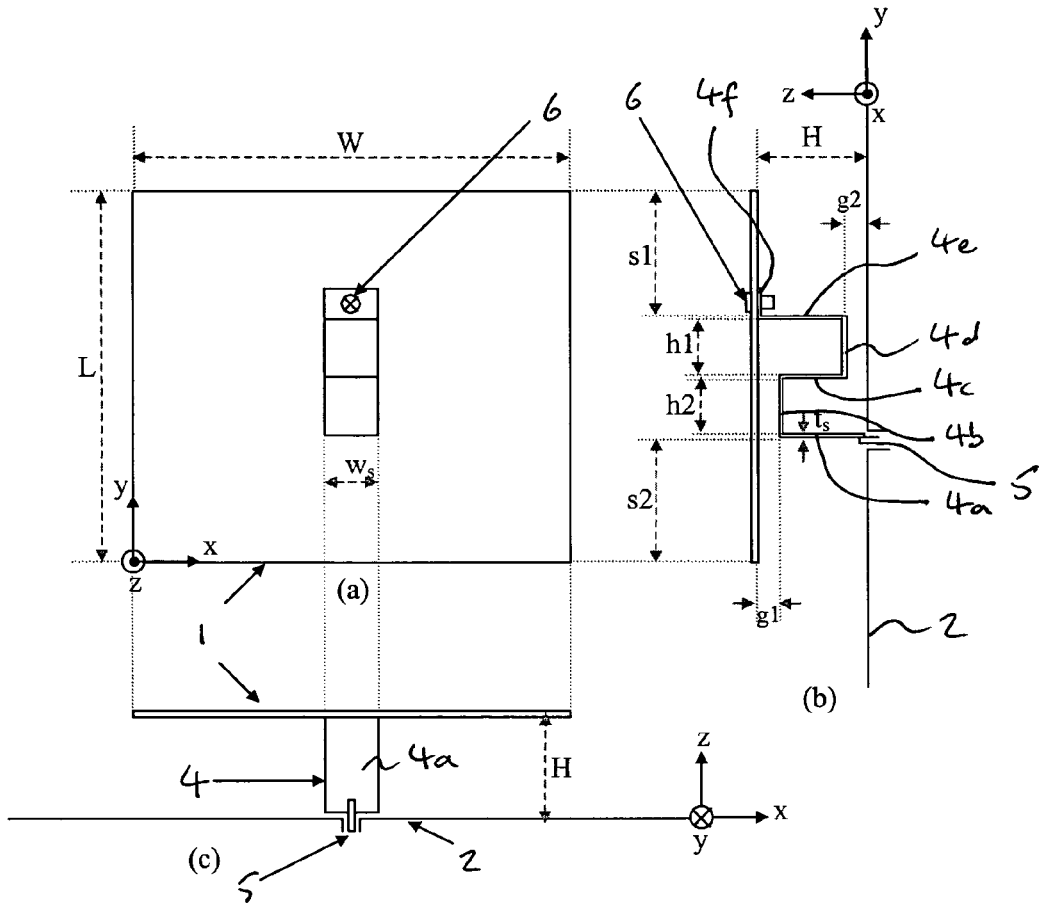
FIG.1(a)-(c)

(d)

(a)

(b)

WIDEBAND PATCH ANTENNA WITH MEANDERING STRIP FEED

FIELD OF THE INVENTION

This invention relates to a patch antenna, and in particular to a patch antenna having a relatively wide bandwidth with low cross-polarization.

BACKGROUND OF THE INVENTION

Microstrip patch antennas have become very popular in recent years in a wide variety of applications. They have a number of advantages including low cost, small size and light weight that make them very suitable, for example, in personal communication systems.

A conventional microstrip patch antenna comprises a patch of a given geometrical shape (eg circular, rectangular, triangular) spaced from a ground plane and separated from the ground plane by a dielectric. Normally the patch is fed by means of a feed probe with a coaxial feed. The feed probe may couple to the patch either directly or indirectly/

PRIOR ART

One drawback, however, with microstrip patch antennas is that they have a relatively low bandwidth and are not generally suitable for broad bandwidth applications. A number of approaches have been taken over the years to try and increase the bandwidth of microstrip patch antennas. Prior proposals, for example, have included adding a second parasitic patch electromagnetically coupled to the driven patch (R. O. Lee, K. F. Lee, J. Bobinchak *Electronics Letters* Sep. 24, 1987, Vol. 23 No. 20 pp 1017–1072), tuning out the probe inductance with a capacitive gap which allows the use of a thick substrate (P. S. Hall *Electronics Letters* May 21, 1987 Vol. 23 No. 11 pp 606–607), and including a U-shaped slot in the patch antenna (K. F. Lee et al *IEE Proc. Microw. Antennas Propag.*, Vol. 144 No. 5 October 1997).

None of these prior art approaches to the problem are ideal however. The use of a parasitic patch overlying the driven patch undesirably increases the thickness of the antenna. The capacitive gap needs to be fabricated with high precision. Introducing a U-shaped slot gives an antenna with high cross-polarisation and cannot be used for circularly polarized radiation.

Another example of the prior art is shown in U.S. Pat. No. 4,724,443 (Nysen). Nysen describes a patch antenna in which a stripline feed element is coupled electromagnetically to a patch, and in which one end of the strip (which is parallel to the patch) is connected by the inner conductor of a coaxial cable (which is normal to the patch). In this design only the strip is coupled to the patch and the antenna is not wide in its bandwidth.

U.S. Pat. No. 6,593,887 (the contents of which are incorporated by reference) describes a patch antenna that is driven by an L-shaped probe disposed between the patch and the ground plane. The probe has a first portion normal to both the patch and the ground plane, and a second portion parallel to both the patch and the ground plane. The lengths of the two portions are selected so that the inductive reactance of the first portion is cancelled by the capacitive reactance of the second portion. This design is quite effective, however the antenna of U.S. Pat. No. 6,593,887 can achieve a gain of only about 7.5 dBi and the cross-polarisation of the antenna remains quite high at about −15 dB. The concept of using an L-shaped probe is also discussed in K. M. Luk et al, "Broadband microstrip patch antenna," *Electron. Lett.,* 1998, Vol. 34, pp. 1442–1443.

With prior art approaches cross-polarisation remains an issue. Phase cancellation can be employed to suppress the cross-polarisation and this is described in A. Petosa et al, "Suppression of unwanted probe radiation in wideband probe-fed microstrip patches," *Electron. Lett.*, Vol. 35, pp. 355–357, 1999 and Levis et al, "Probe radiation cancellation in wideband probe-fed microstrip arrays," *Electron. Lett.*, Vol. 36, pp. 606–607, 2000. This method can effectively suppress the cross-polarisation. However, the method needs a wideband matching network to feed the two strips 180° out of phase with each other which increases the complexity of the antenna structure.

Chen et al, "Broadband suspended probe-fed antenna with low cross-polarisation levels," *IEEE Trans. Antennas Propagat,*. Vol. AP-51, pp. 345–346, Feb. 2003 proposes a suspended probe-fed antenna with an impedance bandwidth of 20% (SWR <2) and a cross-polarisation less than −20 dB across the operating bandwidth. However, this design has the disadvantage of having a very long horizontal strip extending outside of the patch. This strip will make the effective projection area of the patch too large for constructing antenna arrays in real-life applications. In addition the antenna gain is only 5 dBi which is low compared to other patch antenna designs.

Another approach is taken in Chinese patent application 0410042927.8 in which a pair of L-shaped probes are disposed between the patch and the ground plane.

SUMMARY OF THE INVENTION

According to the present invention there is provided a patch antenna comprising a patch spaced from a ground plane, the patch being substantially parallel with the ground plane, and a feed probe located between the patch and the ground plane, wherein the feed probe comprises at least two portions parallel to the patch and spaced by different distances from the patch.

In preferred embodiments of the invention the parallel portions of the feed probe are separated by portions of the feed probe that extend normal to the patch. Preferably one such normal portion is formed with a coaxial feed at one end thereof.

In one preferred set of embodiments the feed probe comprises 2n portions that are parallel to the patch, and 2n+1 portions that are normal to the patch (where n is an integer). In this set of embodiments it is preferred that the parallel portions comprise pairs of portions whereby the portions in each pair said portions are of equal length and one portion of a pair is spaced from the patch by the same distance that the other portion of the same pair is spaced from the ground plane.

In general terms it is preferred that a first of said at least two parallel portions is spaced from the patch by a first distance, and a second of the at least two parallel portions is spaced from the ground plane by the first distance. The parallel portions are preferably of equal length, and may be of equal or differing width.

In an alternative set of embodiments there are provided an odd number of parallel portions wherein at least one parallel portion is equispaced from the patch and the ground plane, and wherein all other parallel portions are disposed in pairs of equal length and with one parallel portion of each pair being disposed by a first distance from the ground plane and the other parallel portion of each pair being disposed by the same distance from the ground plane.

The feed probe may be coupled to the patch by a normal portion that extends to and contacts the patch. Alternatively the feed probe may be proximity coupled to the patch by means of a coupling portion that extends parallel to the patch.

The feed probe may take a number of different forms. For example the probe may comprise an integrally formed metal strip. Alternatively the feed probe could be formed by a conductive track formed on a printed circuit board. In this latter embodiment the printed circuit board also serves to space said patch from said ground plane.

BRIEF DESCRIPTION OF THE DRAWINGS

Some embodiments of the invention will now be described by way of example and with reference to the accompanying drawings, in which.

DETAILED DESCRIPTION OF PREFERRED EMBODIMENTS

Figure 1D:
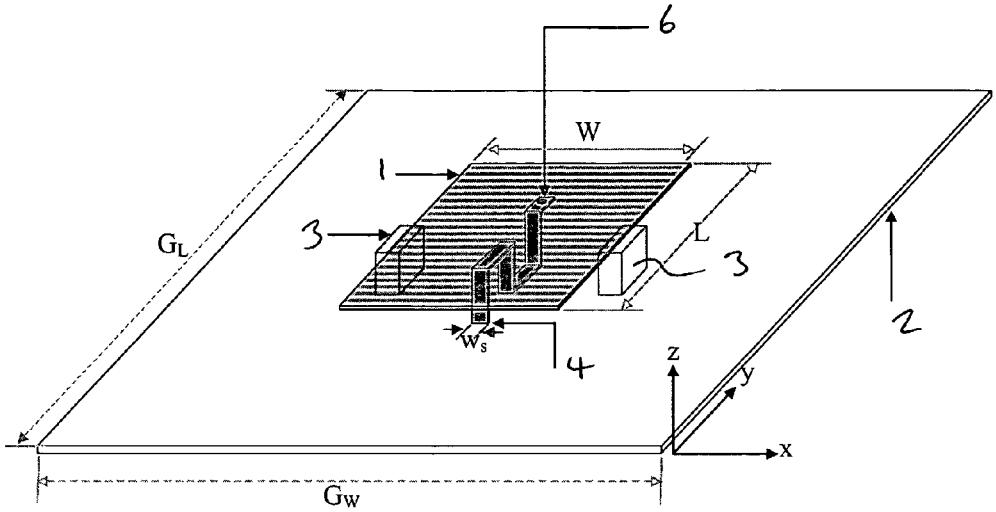
FIGS. 1(*a*)–(*d*) show plan, side and perspective views of a patch antenna according to an embodiment of the invention.

Referring firstly to FIGS. 1(*a*)–(*d*) there is shown a patch antenna according to a first embodiment of the invention. The antenna comprises a patch 1. As is known in the art the patch can be any convenient shape (including for example circular and triangular patches), but is preferably rectangular of dimensions W (typically $0.3\lambda<W<0\lambda$, where $\lambda$ is the intended central operating wavelength of the antenna)×L (typically $0.35\lambda<L\ 0.45\lambda$). The patch 1 is parallel to a ground plane 2 and spaced therefrom by a distance H ($0.05\lambda<H<0.25\lambda$) for example by foam spacer elements 3. The dimensions of the ground plane are not critical, but the ground plane should be significantly greater in size than the patch. In the embodiment of FIGS. 1(*a*)–(*d*) the ground plane has the dimensions $G_W \times G_L$ where $G_W$ is approximately $1.21\lambda$ and $G_L$ approximately $1.82\lambda$. A feed probe in the form of a strip feed 4 (to be described in more detail below) is provided between the patch 1 and the ground plane 2 and is adapted to couple electromagnetically to the patch 1. One end of the strip feed 4 is connected to a coaxial feed 5.

As can be seen in particular from FIGS. 1(*b*) and 1(*d*) the strip feed 4 has a meandering form and comprises a number of portions that extend respectively normal and parallel to the ground plane and the patch. The strip feed 4 is preferably integrally formed by bending a metal strip of width $w_s$ (eg $0.06\lambda$) and thickness $t_s$ (eg $0.0012\lambda$) so that it has three portions normal to the ground plane and patch, and two portions parallel to the ground plane and patch. For example, as shown in the embodiment of FIGS. 1(*a*)–(*d*) the strip feed 4 comprises a first normal portion 4*a* that extends from the ground plane 2 towards the patch 1 (but does not reach the patch 1) and first normal portion 4*a* is formed with the coaxial feed 5 at one end thereof. A first parallel portion 4*b* of the strip feed 4 begins at the end of the first normal portion 4*a* remote from the coaxial feed and extends parallel to the patch 1 spaced therefrom by a constant distance g1 (typically $0.01\lambda$) for a length h2 (typically $0.06\lambda$). A second normal portion 4*c* is then provided that extends normal to the patch 1 and towards the ground plane 2 but stops short of the ground plane by a distance g2 (g2=g1). A second parallel portion 4*d* is then provided that extends parallel to the ground plane spaced therefrom by the distance g2 for a length h1 (h1=h2). At the end of the second parallel portion 4*d* a third normal portion 4*e* is provided that extends towards the patch 1. Third normal portion 4*e* in fact contacts the patch 1 where the strip feed 4 is fixed to the patch by means of a plastic screw 6 that fixes the strip feed 4 to the patch 1 through a fastening portion 4*f* of the strip feed.

It may be noted that while in this example the strip feed is of uniform width, it may also be possible to form the different portions of the strip feed of differing widths in order to provide further flexibility and greater ability to control the operational parameters of the antenna.

In order to provide two current flows in the strip 180° out of phase, which is advantageous in order to be able to suppress the cross-polarisation radiation contributed by the normal portions 4*a*, 4*c*, 4*e* of the strip feed 4, the spacing of the first and second parallel portions 4*b*, 4*d* respectively from the patch 1 and the ground plane 2 (ie g1 and g2), and the lengths of the parallel portions 4*b*, 4*d* (ie h2 and h1) should be identical, ie g1=g2 and h1=h2. It is also possible, however, that in some embodiments it may be preferable to form the parallel portions of different lengths from each other, and with differing spacings from the patch and ground plane respectively, since varying these parameters may allow the operational performance of the antenna to be adjusted.

In general terms the strip feed 4 can be located at any position between the patch 1 and the ground plane 2. Preferably, however, it is located symmetrically with respect to the patch 1 and in the embodiment of FIG. 1 the strip forming the strip feed 4 extends parallel to the short sides L of the patch, and the ends of the strip feed 4 are equispaced from the long sides W of the patch 1 by distances s1, s2, s1=s2.

Table 1 below gives typical design parameters for a wideband patch antenna conducted in accordance with the embodiment of FIG. 1 and adapted to be operated at a centre frequency of 1.85 GHz.

TABLE 1

| Parameter | Value (mm) | Value (Wavelength fraction) |
|---|---|---|
| L | 60 | $0.364\lambda$ |
| W | 70 | $0.425\lambda$ |
| H | 17.5 | $0.106\lambda$ |
| $G_L$ | 300 | $1.82\lambda$ |
| $G_W$ | 200 | $1.21\lambda$ |
| g1 = g2 | 1.5 | $0.01\lambda$ |
| h1 = h2 | 9.5 | $0.06\lambda$ |
| s1 = s2 | 20.2 | $0.123\lambda$ |
| $t_s$ | 0.2 | $0.0012\lambda$ |
| $w_s$ | 9.5 | $0.06\lambda$ |

Figure 2:
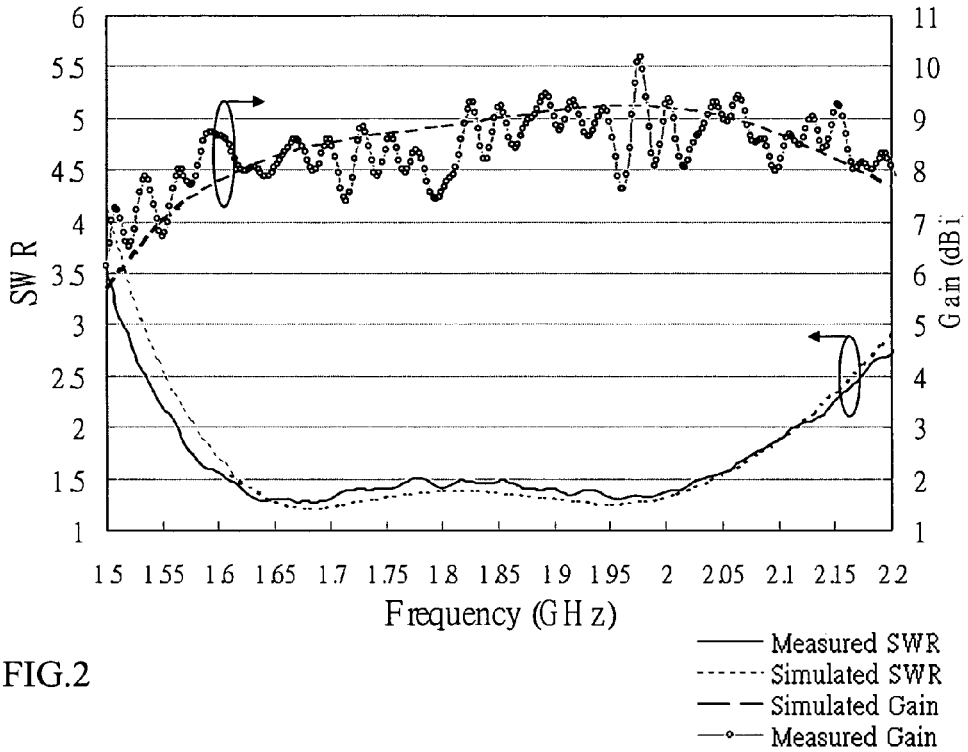
FIG. 2 shows measured gain and standing wave ratio (SWR) results for the antenna of FIG. 1.
Figure 3:
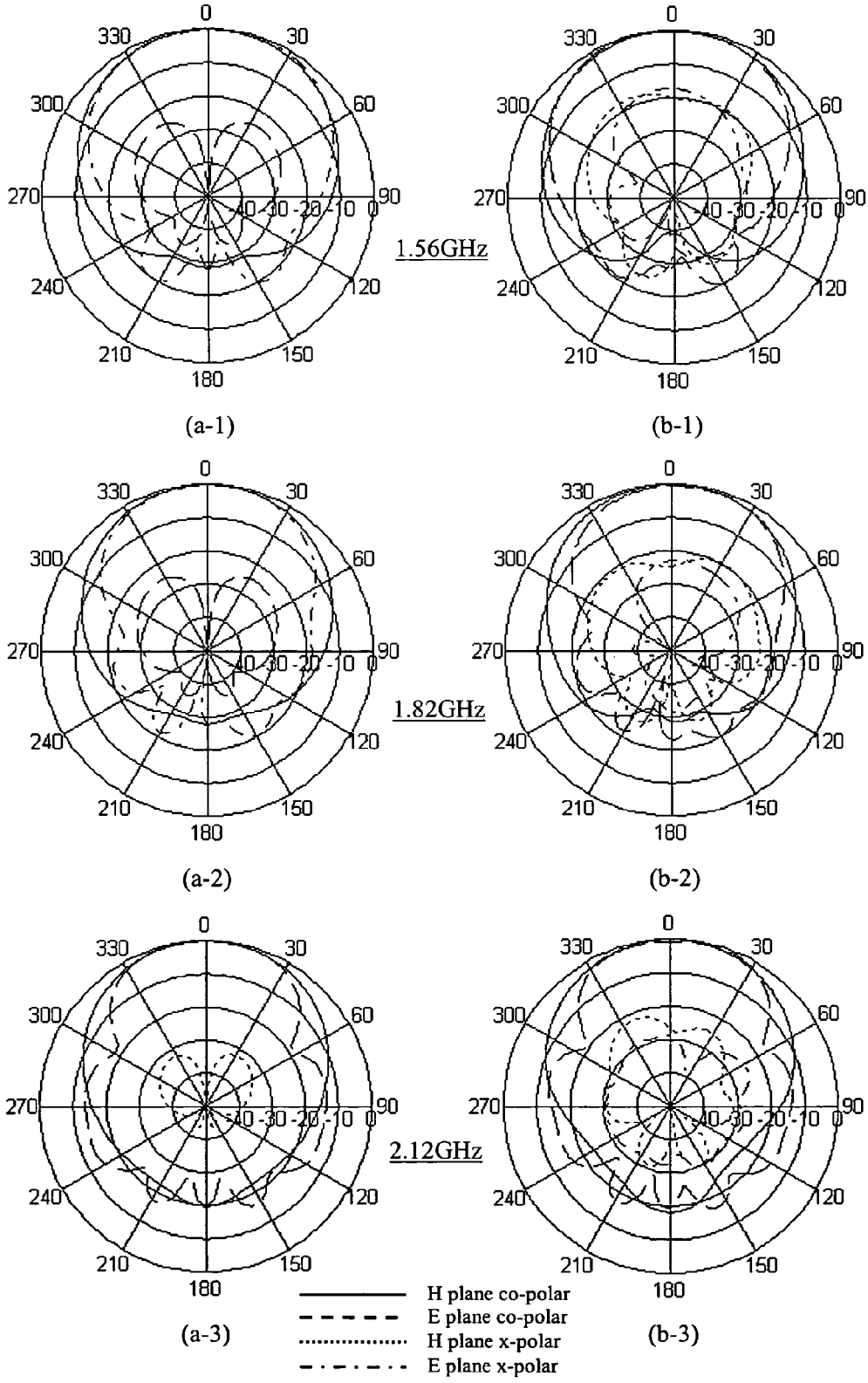
FIG. 3 shows simulated and measured radiation patterns for the antenna of FIG. 1, FIG. 4(*a*)–(*c*) show alternative forms for the meandering strip, FIGS. 5(*a*) and (*b*) show perspective and side views respectively of an antenna according to a second embodiment of the invention, FIGS. 6(*a*) and (*b*) show respectively plan and side views of an antenna according to a further embodiment of the invention, and FIGS. 7(*a*) and (*b*) show respectively plan and side views of an antenna according to a still further embodiment of the invention.

FIG. 2 shows the measured and simulated gain and standing wave ratio results for an antenna fabricated in accordance with the embodiment of FIGS. 1(*a*)–(*d*) operating at a central frequency of 1.85 GHz. FIG. 3 shows simulated and measured radiation patterns from the same antenna at 1.56 GHz, 1.82 GHz and 2.12 GHz. As shown in FIG. 2, according to the experimental results the antenna can be operated from 1.56 GHz to 2.12 GHz with a bandwidth of 30.5% (SWR <2).

Figure 4:
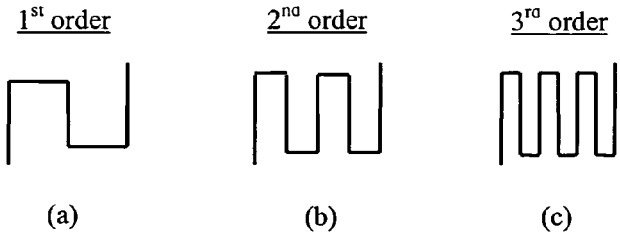

The embodiment of FIG. 1 comprises two parallel portions (4*b*, 4*d*) of the strip feed 4 and may be termed a first order strip. It is also possible to form a strip feed of a higher order as illustrated in FIGS. 4(*a*)–(*c*) which shows schematically (a) a first order strip having two parallel portions and three normal portions (as in the embodiment of FIGS. 1(*a*)–(*d*), (b) a second order strip having four parallel portions and five normal portions, and (c) a third order strip having six parallel portions and seven normal portions. In general terms a strip of the nth order can be defined has having 2n parallel portions and 2n+1 normal portions.

Figure 5:
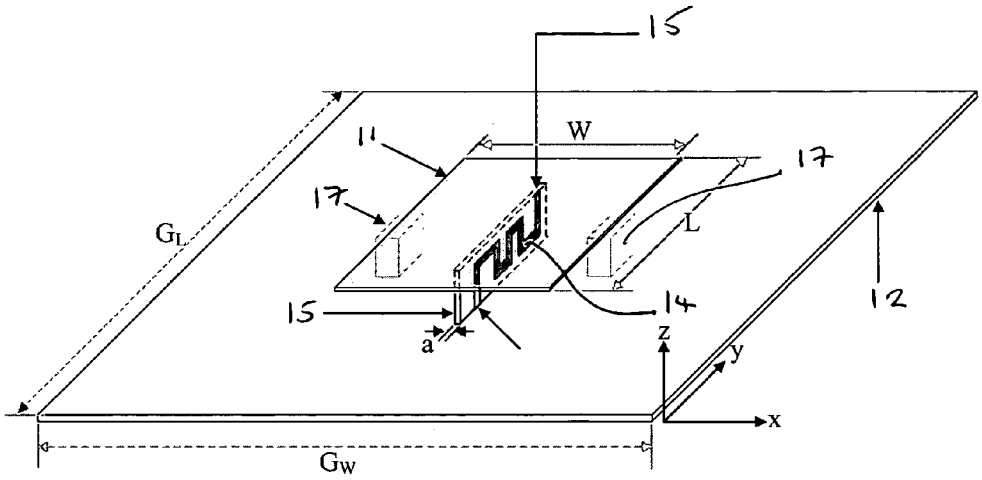
Figure 5:
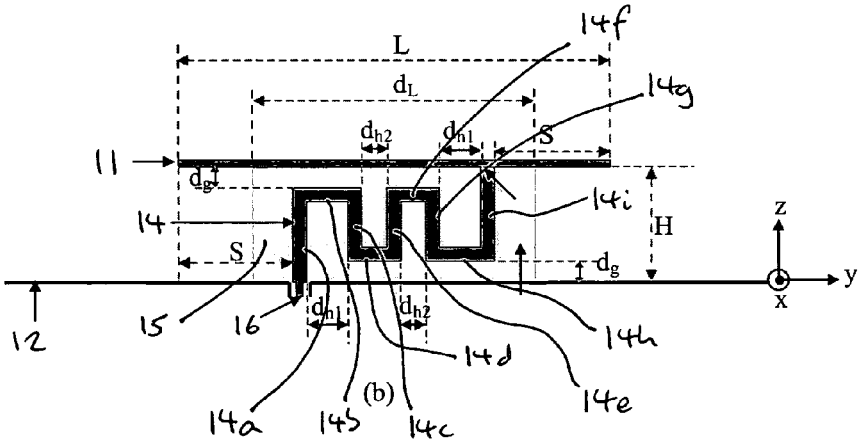

FIG. 5 shows another embodiment of the invention in the form of a second order strip feed. In this embodiment the feed probe 14 is formed not from bending a metal strip, but is formed as a conductive track (2 mm wide for example) deposited on a printed circuit board 15. In this construction the printed circuit board 15 also serves as a further spacer element for spacing the patch 11 above the ground plane 12 (although spacer elements 17 would also be provided) and the printed circuit board has thickness a dimensions $d_L \times H$ where H is the spacing between the patch 11 and the ground plane 12. In the embodiment of FIG. 5 the strip feed 14 comprises a first normal portion 14*a* (at one end of which is formed a coaxial feed 16), a first parallel portion 14*b*, second normal portion 14*c*, second parallel portion 14*d*, third normal portion 14*e*, third parallel portion 14*f*, fourth normal portion 14*g*, fourth parallel portion 14*h*, and finally fifth normal portion 14*i* that connects to the patch 11. The ends of the strip feed 14 are spaced from the edges of the patch 11 by a distance S.

As in the embodiment of FIG. 1 the lengths of the parallel portions are preferably matched in order to minimize cross-polarisation. In this embodiment, for example the lengths $d_{h1}$ of the first and fourth parallel portions 14*b*,14*h* are equal, and the lengths of the lengths $d_{h2}$ of the second and third parallel portions 14*d*,14*f* are also equal to each other. The first and third parallel portions 14*b*,14*f* are spaced from the patch 11 by a distance $d_g$ that is the same as the spacing of the second and fourth parallel portions 14*d*,14*h* from the ground plane 12. Table 2 shows typical dimensions of an antenna according to the embodiment of FIG. 5 designed for a central operating frequency of 1.77 GHz.

TABLE 2

| Parameter | Value (mm) | Value (Wavelength fraction) |
|---|---|---|
| L | 60 | 0.354λ |
| W | 70 | 0.413λ |
| H | 16.5 | 0.097λ |
| $G_L$ | 300 | 1.77λ |
| $G_W$ | 200 | 1.18λ |
| $d_L$ | 40 | 0.236λ |
| $d_g$ | 3 | 0.0177λ |
| $d_{h1}$ | 5.8 | 0.342λ |
| $d_{h2}$ | 3.5 | 0.021λ |
| a | 1.6 | 0.009λ |
| S | 16.2 | 0.0985λ |

Figure 6:
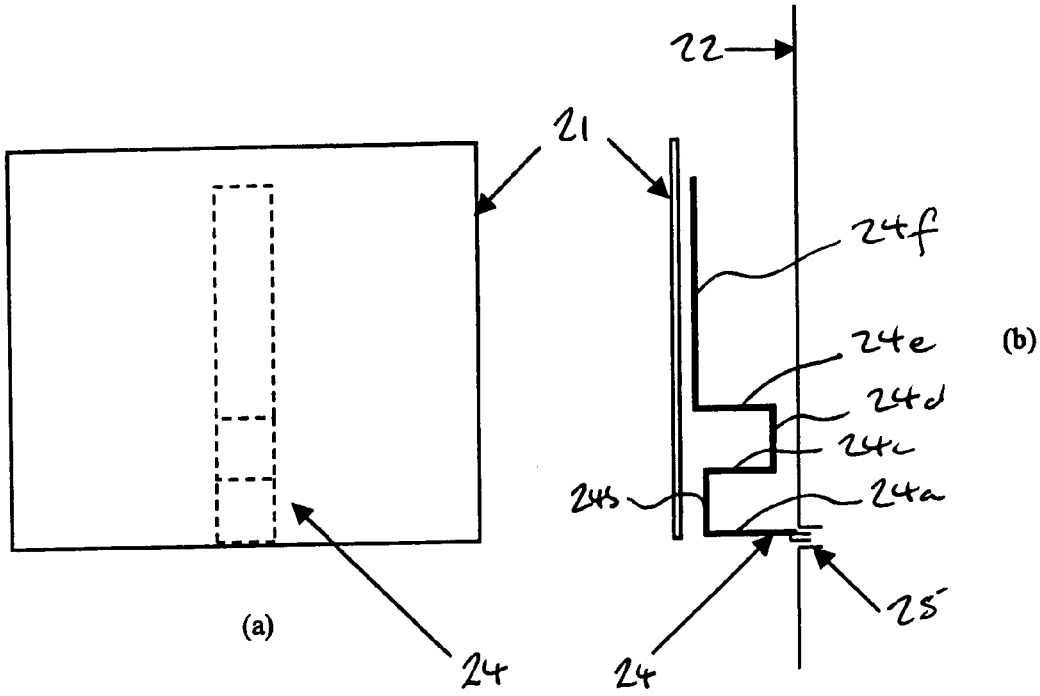

In the embodiments of FIGS. 1 and 5, the strip feeds 4,14 are directly coupled to the patches 1,11. This is not essential, however, and the strip feed could be proximity-coupled to the patch as shown in the example of FIG. 6. In this example the strip feed 24 comprises a first normal portion 24*a*, first parallel portion 24*b*, second normal portion 24*c*, second parallel portion 24*d* and third normal portion 24*e*, but rather than a direct coupling of the strip feed 24 to the patch 21 at the end of the third normal portion 24*e* there is provided a coupling portion 24*f* that extends parallel to the patch 21 but does not contact the patch. In this embodiment the coupling portion 24*f* is relatively long compared to parallel portions 24*b*, 24*d* and to accommodate this length the coaxial feed 25 is provided at a point opposite a side edge of the patch 21.

Figure 7:
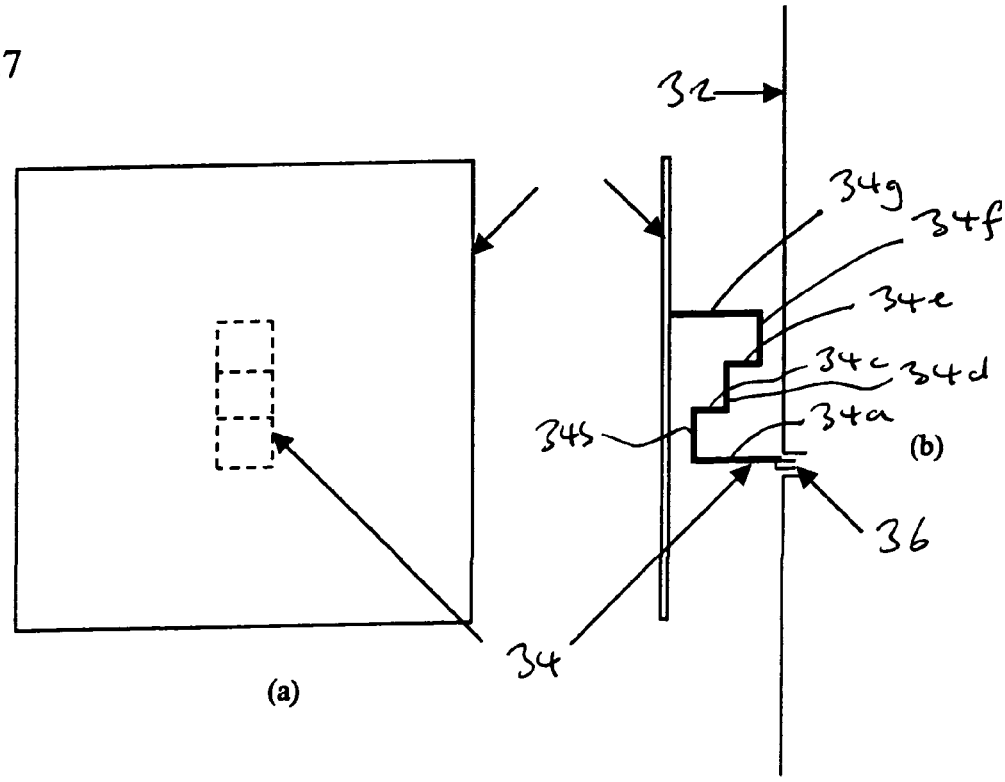

In all the preceding embodiments the parallel portions of the strip feed are arranged so that they are alternately closer to the patch or closer to the ground plane. FIG. 7, however, shows an alternative possibility in which there are three parallel portions 34*b*, 34*d*, 34*f* which get progressively closer to the ground plane. In this example the first parallel portion 34*b* is spaced a distance from the patch 31 that is the same as the spacing of the third parallel portion 34*f* from the ground plane 32. The second parallel portion 34*d* is equispaced from the patch 31 and the ground plane 32. A first normal portion 34*a* connects the coaxial feed 36.

The invention claimed is:

1. A patch antenna comprising a patch spaced from a ground plane, said patch being substantially parallel with said ground plane, and a feed probe located between said patch and said ground plane, wherein said feed probe comprises at least two portions in the space between said patch and said ground plane, parallel to said patch and spaced by different distances from the patch.

2. An antenna as claimed in claim 1 wherein said parallel portions of said feed probe are separated by portions of said feed probe that extend normal to said patch.

3. An antenna as claimed in claim 2 wherein a first said normal portion of said feed probe is formed with a coaxial feed at one end thereof.

4. An antenna as claimed in claim 1 wherein said at least two parallel portions are of equal length.

5. An antenna as claimed in claim 1 wherein said at least two parallel portions are of differing length.

6. An antenna as claimed in claim 1 wherein said at least two parallel portions are of equal width.

7. An antenna as claimed in claim 1 wherein said at least two parallel portions are of different widths.

8. An antenna as claimed in claim 1 wherein said feed probe is coupled to said patch by a normal portion that extends to and contacts said patch.

9. An antenna as claimed in claim 1 wherein said feed probe is proximity coupled to said patch by means of a coupling portion that extends parallel to said patch.

10. An antenna as claimed in claim 1 wherein said feed probe comprises an integrally formed metal strip.

11. An antenna including a patch spaced from and substantially parallel with a ground plane, and a feed probe located between said patch and said ground plane, wherein said feed probe comprises 2n portions that are parallel to said patch and spaced by different distances from the patch, and 2n+1 portions that are normal to said patch.

12. An antenna as claimed in claim 11 wherein said parallel portions comprise:

pairs of portions whereby in each pair said portions are of equal length and one portion of a said pair is spaced from the patch by the same distance that the other portion of said pair is spaced from the ground plane.

13. An antenna including a patch spaced from and substantially parallel with a ground plane, and a feed probe located between said patch and said ground plane, wherein said feed probe comprises at least two portions parallel to said patch, and a first of said at least two parallel portions is spaced from the patch by a first distance, and a second of said at least two parallel portions is spaced from said ground plane by said first distance.

14. An antenna including a patch spaced from and substantially parallel with a ground plane, and a feed probe located between said patch and said ground plane, wherein said feed probe comprises an odd number of portions parallel to said patch, and wherein at least one parallel portion is equal distance from the patch and the ground plane, and wherein all other parallel portions are disposed in pairs of equal length and with one parallel portion of each pair being disposed by a first distance from the ground plane and the other parallel portion of each pair being disposed by the same distance from said ground plane.

15. An antenna including a patch spaced from and substantially parallel with a ground plane, and a feed probe located between said patch and said ground plane, wherein said feed probe comprises a conductive track formed on a printed circuit board and having at least two portions parallel to said patch and spaced by different distances from the patch.

16. An antenna as claimed in claim 15 wherein said printed circuit board serves to space said patch from said ground plane.

17. An antenna including a patch spaced from and substantially parallel with a ground plane, and a feed probe located between said patch and said ground plane, wherein said feed probe comprises at least two portions parallel to said patch, and said feed probe is coupled to said patch directly by a normal portion that extends to and contacts said patch.

* * * * *